US006123215A

United States Patent [19]

Windle

[11] Patent Number: 6,123,215

[45] Date of Patent: Sep. 26, 2000

[54] WASTE RECEPTACLE

[76] Inventor: William W. Windle, 1220 Shore La., Syracuse, Ind. 46567

[21] Appl. No.: 09/207,716

[22] Filed: Dec. 9, 1998

[51] Int. Cl.[7] ..... B65D 25/14

[52] U.S. Cl. ..... 220/495.07; 220/495.08; 220/505

[58] Field of Search ..... 220/908.1, 908, 220/909, 23.83, 23.86, 23.8, 23.4, 495.07, 495.08, 505

[56] References Cited

U.S. PATENT DOCUMENTS

| | | | |
|---|---|---|---|
| 3,300,082 | 1/1967 | Patterson . | |
| 3,760,975 | 9/1973 | Nilsson . | |
| 4,349,123 | 9/1982 | Yang . | |
| 4,519,502 | 5/1985 | Jackson, II et al. . | |
| 4,721,226 | 1/1988 | Yurko . | |
| 4,798,363 | 1/1989 | Cortesi . | |
| 4,823,979 | 4/1989 | Clark, Jr. . | |
| 4,834,262 | 5/1989 | Reed . | |
| 4,850,507 | 7/1989 | Lemongelli et al. . | |
| 4,938,380 | 7/1990 | Donahoe | 220/404 |
| 4,955,505 | 9/1990 | Battaglia . | |
| 5,111,951 | 5/1992 | Breen et al. . | |
| 5,295,607 | 3/1994 | Chang . | |
| 5,322,179 | 6/1994 | Ting . | |
| 5,322,180 | 6/1994 | Ker . | |
| 5,372,272 | 12/1994 | Jennings . | |
| 5,392,916 | 2/1995 | Paulison | 206/518 |
| 5,405,041 | 4/1995 | Van Brackle . | |
| 5,419,453 | 5/1995 | Lochridge . | |
| 5,458,350 | 10/1995 | Johnson et al. | 280/47.26 |
| 5,579,915 | 12/1996 | Liss | 206/554 |
| 5,628,424 | 5/1997 | Gola . | |
| 5,632,401 | 5/1997 | Hurd . | |
| 5,678,723 | 10/1997 | Swift et al. . | |
| 5,730,312 | 3/1998 | Hung . | |
| 5,738,239 | 4/1998 | Triglia . | |

*Primary Examiner*—Stephen Castellano
*Attorney, Agent, or Firm*—Woodard, Emhardt, Naughton, Moriarty & McNett

[57] ABSTRACT

An improved waste receptacle and method for disposing of waste is disclosed. The receptacle includes a container portion configured to receive a liner therein. The container includes a pair of liner retainer elements secured to the outside surface on opposite sides of the container. In one embodiment, the liner retaining element includes a pair of spaced flanges protruding from the wall of the container. The liner retaining elements are configured to receive a portion of the liner disposed in the container and prevent the liner from collapsing into the container as waste is placed therein. In another embodiment, the waste receptacle includes a dispenser for storing a plurality of liners. The dispenser is engaged to the wall of the container. In one embodiment, the liners have an initial use that does not include storing waste or lining a waste receptacle. The liners are recycled by storing them in the dispenser, and each is later used as a liner for the waste receptacle as needed.

19 Claims, 5 Drawing Sheets

WASTE RECEPTACLE

BACKGROUND OF THE INVENTION

The present invention relates generally to a waste receptacle, and more particularly, the invention relates to a waste receptacle having a mechanism for securing a liner disposed within the receptacle and/or a compartment for storing liners to be placed within the receptacle.

There are many designs and configurations for waste baskets, trash cans, and other receptacles used to store the waste and trash produced through various activities at the home or office. Such waste baskets may differ in shapes or size, or include features such as a lid, handles, or wheels. However, all have at least one common attribute: each must be emptied when it is filled with trash or waste. This common attribute found in all waste baskets is the source for some of the problems create for their users.

For example, many users place the trash or waste inside the waste basket directly against the bottom and inside surfaces of the walls without a liner in the waste basket. While eliminating the cost associated with purchasing liners for the waste basket, this type of use has many unfortunate drawbacks. For example, a mess is created within the container, trash removal is made more difficult and time consuming, and staining and/or permanent defacement of the inside surface of the waste basket often occurs. To protect the receptacle from such problems, liners may be purchased and placed within the waste basket to provide a barrier between the waste and the inside surfaces of the waste basket. The liner helps maintain the cleanliness of the waste basket, thus providing a longer useful life for it. The liner also allows the waste to be removed easily by simply lifting the liner out of the waste basket. The liner and the waste may then be transported to a central collection point without the need to transport the entire waste basket. While the use of liners eliminates some of the problems for users of waste baskets, problems still exist, many of which are created by the use of liners.

One problem associated with the use of liners in waste baskets concerns the availability of the liners to the user when it is desired to empty the trash. Commonly, additional liners are stored at a location in the house or facility remote from the waste basket. If it is observed that the waste basket requires emptying, the user must remove the liner filled with trash and take the trash to a central collection point. The user must then go to the liner storage location in order to obtain a second liner. The user then returns to the empty waste basket in order to place the second liner therein. Thus, the user wastes time by having to return to the waste basket after it has been emptied in order to replace the liner.

Waste baskets allowing storage of liners adjacent thereto have been the subject of previous patents. For example, U.S. Pat. No. 5,628,424 to Gola discloses a trash receptacle having a base that allows a roll of bags to be stored below the body of the receptacle. The replacement bag is pulled upward from the base as the bag filled with waste is removed. The replacement bag is then draped over the top edges of the body portion. In order to place the bags within the base, the receptacle must be disassembled. Also, the bags must be provided and purchased in the roll form. While Gola represents a step in the right direction, additional problems remain.

A second problem associated with the use of liners is that they often fall or collapse within the receptacle as trash is placed therein. Typically, the liner is placed within the receptacle with its top portion draped over the top edge of the walls of the receptacle. If the liner is too small or short, it has a tendency to want to collapse within the container. If the liner is too large, the bag is inefficiently used because the receptacle requires emptying prior to the bag being full.

Another problem associated with the use of liners with waste baskets is the cost associated with their purchase. Also, the use of liners is not environmentally friendly. The liner creates additional waste for disposal when purchased for the sole purpose of lining a waste basket. Also, there is created pollution and waste resulting from the manufacture and sale of liners used solely for lining waste baskets.

While the prior art has made some steps in the right direction, there still remains a need for additional improvements. Thus, a device is needed which addresses the problems in the prior art. The present invention is directed towards meeting these and other needs in a novel and unobvious way.

SUMMARY OF THE INVENTION

According to one aspect of the invention, a receptacle for storing waste includes a container having a wall with an inner surface defining a storage space and an opposite outer surface, the wall extending between a top edge of the container and an opposite bottom edge of the container. A liner is disposed within the storage space of the receptacle such that the liner has a portion extending outside the storage space. At least one liner retaining element on the wall is configured to receive the portion of the liner outside the storage space in order to prevent collapse of the liner into the storage space.

According to another aspect of the invention, a receptacle for storing waste and for storing a plurality of liners for lining the receptacle is provided. The receptacle includes a container with a wall having an inner surface and an opposite outer surface, the wall defining a storage space and extending between a top edge of the container and an opposite bottom edge of the container. A first liner retaining element and a second liner retaining element are disposed on the outer surface of the wall. Each of the liner retaining elements are configured to receive a portion of one of the liners disposed in the storage space such that the liner retaining elements prevent collapse of the liner in the storage space. A dispenser is engaged to the wall of the container and is sized and configured for storing the plurality of liners.

In another aspect of the invention, a method is provided for placing a liner in a storage space of a container. The method comprises the steps of: (a) providing a plurality of liners; (b) providing a container having a wall defining the storage space, the container including at least one liner retaining element on the wall configured to receive a portion of at least one of the plurality of liners to resist displacement of the liner into the storage space the container further comprising a dispenser engaged to the wall of the container, (c) placing the plurality of liners in the compartment; (d) removing at least one of the plurality of liners from the compartment; (e) placing the at least one liner in the storage space of the container; and (f) engaging a portion of the liner to the at least one liner retaining element. In one embodiment, the plurality liners provided in step (a) are provided after the step of using each plurality of liners for another purpose.

One object of the present invention is to provide an improved waste receptacle and method of using and lining the same. Other objects and advantages will become more apparent from the following description of the preferred embodiments.

DESCRIPTION OF THE PREFERRED EMBODIMENTS

Figure 1:
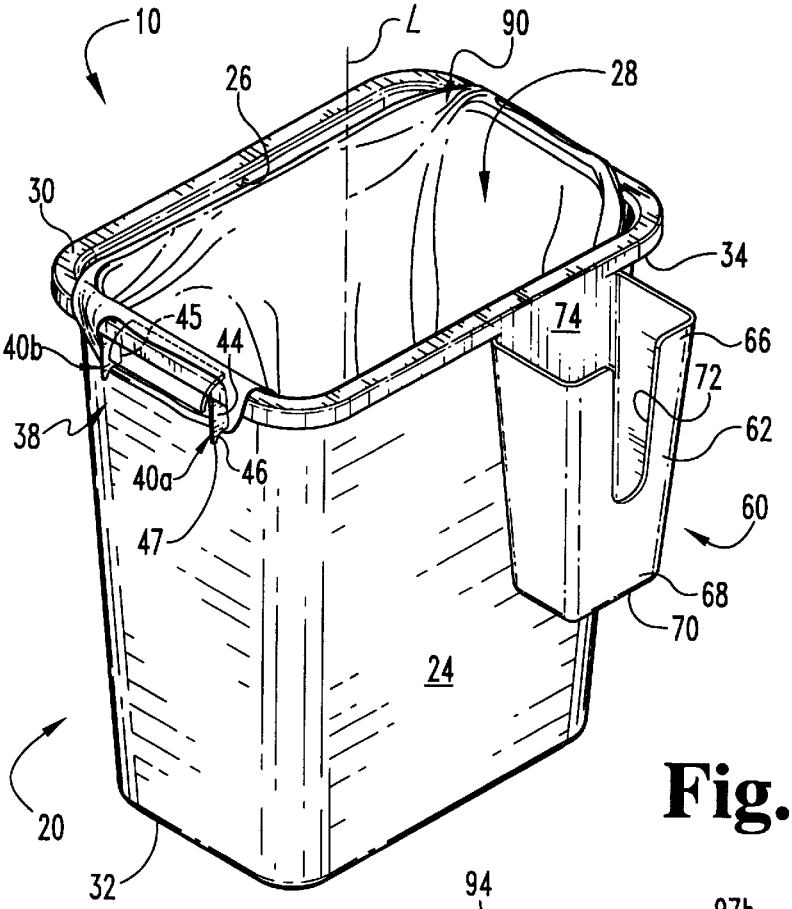
FIG. 1 is a perspective view of a waste receptacle according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

A waste receptacle according to one embodiment of the present invention is illustrated in FIG. 1 and designated generally at 10. The waste receptacle 10 includes a container portion 20 having a dispenser 60 engaged thereto. A plurality of liners 90 may be removably stored within the dispenser 60. A liner 90 is disposed within container 20 for holding waste or other refuse placed therein. The liner 90 is engaged to the container portion 20 to prevent the liner 90 from collapsing therein. Container 20 of receptacle 10 may be generally configured in size and shape to such structures commonly known as a waste basket, a trash can, a garbage can, a recycling container, etc. The receptacle 10 may be used for storing and/or disposing of garbage, refuse, or any other material that may be disposed. Waste receptacle 10 may be used in the home, office, or other place of occupancy where it is desirable to have available a container for storing and disposing of waste.

Figure 2:
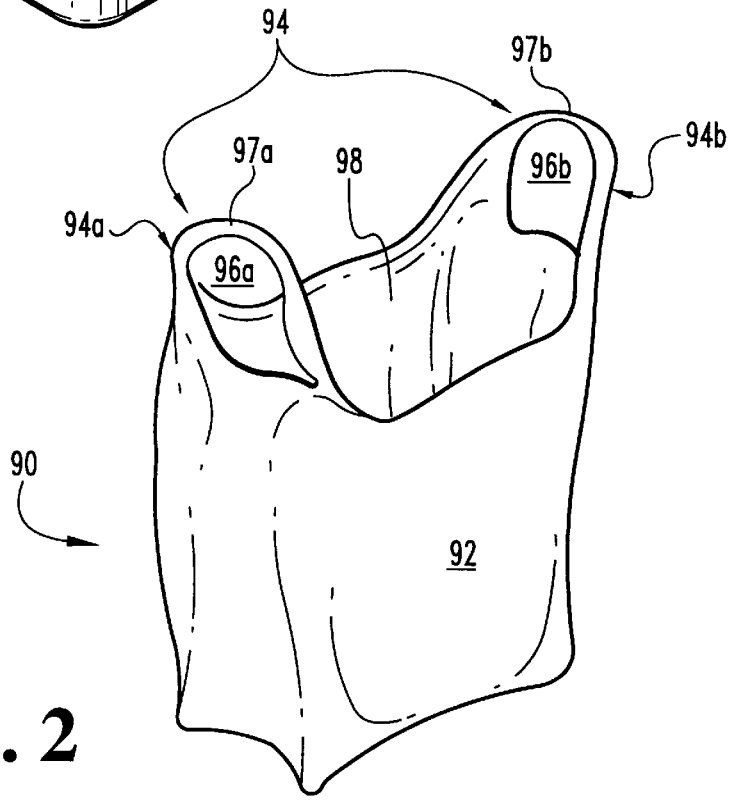
FIG. 2 is a perspective view of a liner usable with the waste receptacle of FIG. 1.

It is commonly known and practiced to line a waste basket or trash can with a plastic liner or bag in order to facilitate handling of the waste and to protect the waste basket or trash can from the waste deposited therein. The liner 90 of the present invention is likewise provided to maintain the cleanliness of the container 20 and provide for the easy removal of the waste and debris placed within the container 20. Referring to FIG. 2, a preferred embodiment liner 90 is illustrated therein. Liner 90 includes a belly or retention portion 92 configured to retain waste or debris placed therein. Belly portion 92 defines a top opening 98 through which the waste or debris is inserted. A pair of straps 94*a*, 94*b* are positioned on either side of belly portion 92. Each strap 94*a*, 94*b* forms a loop 96*a*, 96*b* and includes a grasping portion 97*a*, 97*b* at the top of the strap to allow the liner 90 to be easily carried and lifted from container 20. Liner 90 is typically formed from a thin plastic sheet of material, and container 20 is sized such that belly portion 92 may reside with a portion of straps 94*a*, 94*b* outside the container.

In a most preferred embodiment, liner 90, sometimes called a T-shirt bag, is the type of bag commonly used by department and grocery stores to allow customers to transport purchased goods from the store. Once the liner 90 is emptied of its contents, the liner 90 is typically either discarded or stored for some future reuse at a central location along with other liners 90. The present invention provides a waste receptacle 10 that allows for the efficient and effective reuse of liners 90 obtained from department or grocery stores. However, it should be understood that the present invention also contemplates liners 90 not reused from department or grocery stores, but which are manufactured for and have an intended initial use for lining the waste receptacle 10. In another embodiment, the liner 90 is manufactured for use as a liner with prior art waste baskets and trash cans, but is adaptable for use with the waste receptacle 10 of the present invention.

Figure 4:
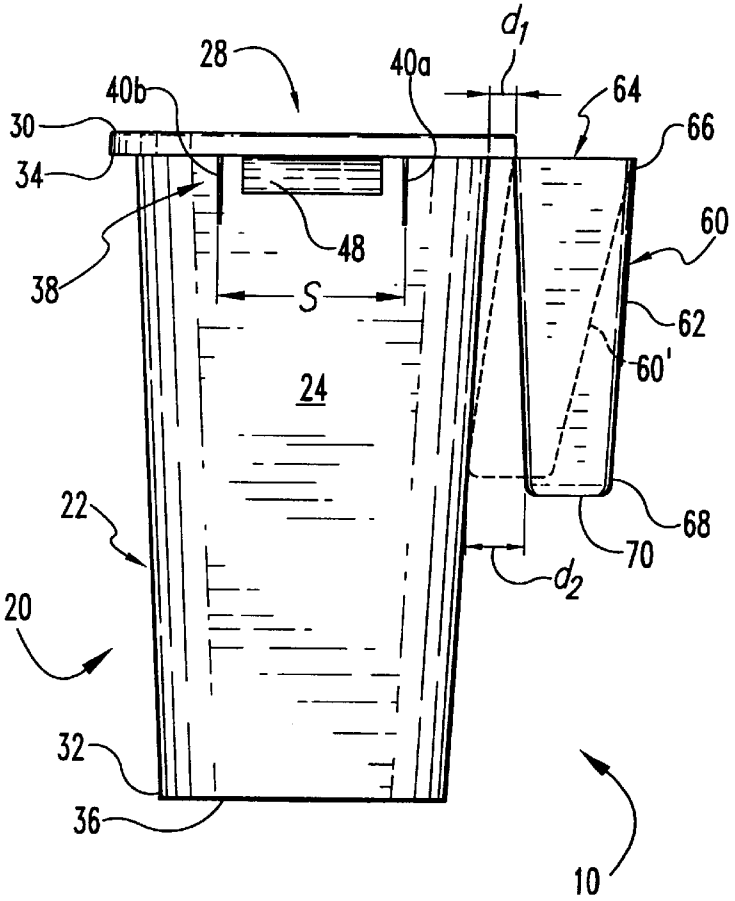
FIG. 4 is a side elevational view of the waste receptacle of FIG. 1.
Figure 3:
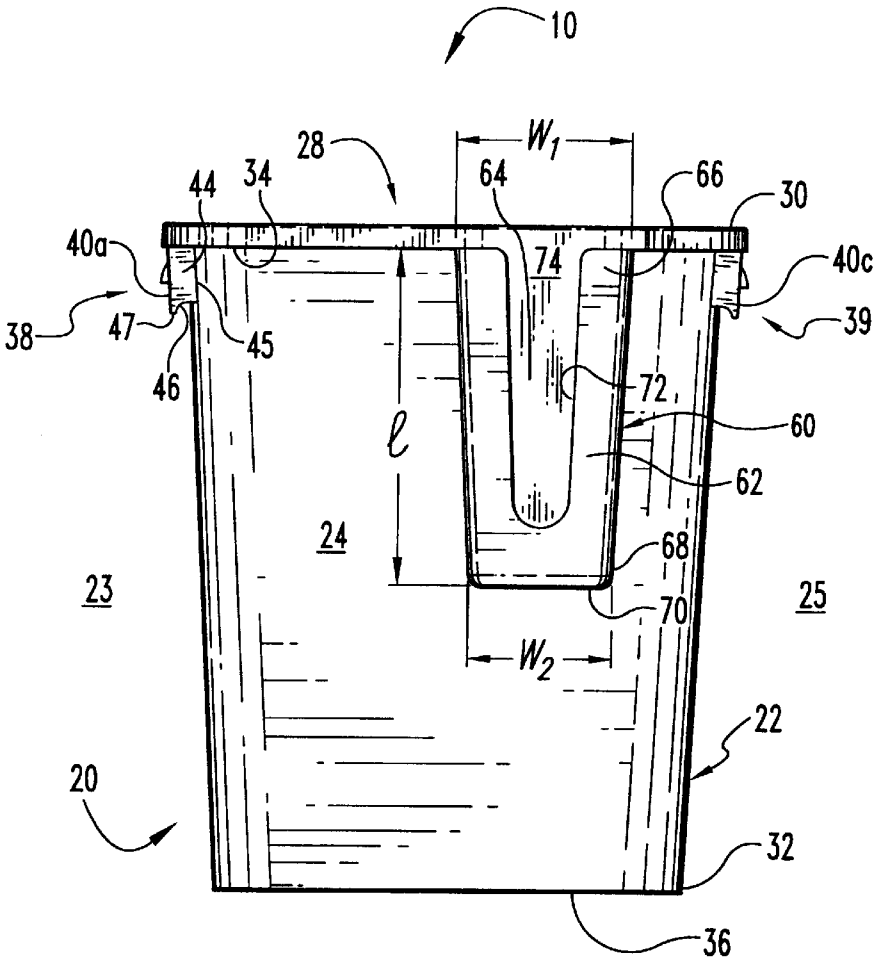
FIG. 3 is a front elevational view of the waste receptacle of FIG. 1.

Referring to FIGS. 1 and 3–4, waste receptacle 10 will now be described in greater detail. FIGS. 3 and 4 illustrate the receptacle 10 with liner 90 removed therefrom. Container 20 includes a wall 22 thereabout that extends from a top edge 30 to a bottom edge 32. Wall 22 has an outer surface 24 and an opposite inner surface 26. Inner surface 26 of wall 22 defines a storage space 28 within the container 20 configured for receiving and retaining waste therein. A longitudinal axis L extends vertically through the center of storage space 28. There is provided a lip 34 extending outward from top edge 30 transverse to axis L. Lip 34 turns downward along a radius towards bottom edge 32 at its terminus. Container 20 includes a bottom surface 36 extending between bottom edges 32. It should be understood that the use of the term "bottom" herein refers to that portion of the receptacle 10 positioned closest to the floor or ground along longitudinal axis L, and "top" refers to that portion furthest from the ground along longitudinal axis L.

A dispenser 60 is mounted on or engaged to wall 22 of container 20. Dispenser 60 is configured to retain a plurality of liners 90 for storage, and to allow removal of a single liner 90 as needed when necessary to line storage space 28 of container 20. Dispenser 60 includes a body portion 62 extending from a top portion 66 to a bottom portion 68 of dispenser 60. In a preferred embodiment, dispenser 60 includes a bottom 70 that closes off bottom portion 68. Body 62 defines a cavity 64 therein configured for the storage of a plurality of liners 90. Wall 62 also has formed therein an elongated slot 72 to facilitate insertion and withdrawal of one or more of the bags 90 from cavity 64. The slot 72 permits insertion of a finger to insert or withdrawal liners and permits visualization of bags in the dispenser 60. In an alternative embodiment, it is contemplated that body 62 does not define a longitudinal slot 72. The edge of slot 72 may be thickened in order to prevent a sharp edge from injuring the finger and to strengthen the structure of the dispenser 60.

Figure 7:
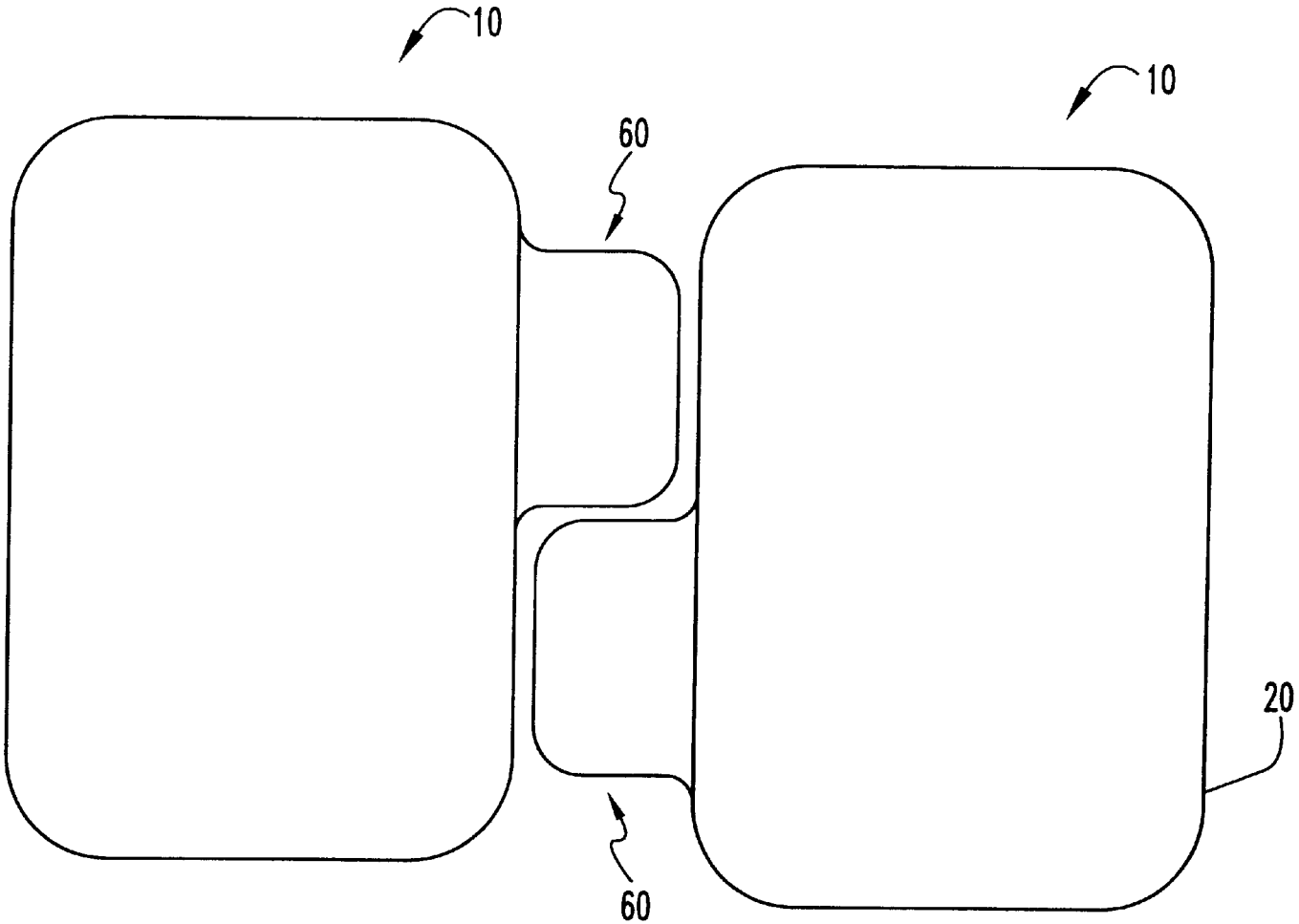
FIG. 7 is a top plan view of an arrangement of two waste receptacles in nested relation.

Referring to FIGS. 3 and 4, dispenser 60 has a first width w1 at top portion 66 and a second width w2 at bottom portion 68. Preferably, first width w1 is greater than second width w2 to provide for ease of insertion and removal of one or more of the plurality of liners 90 from cavity 64. The embodiment illustrated in FIGS. 3–4 is also advantageous in that it allows receptacles 10 to be stacked during storage or display in a store. Such stacking is also facilitated by the fact that the dispenser 60 is located on one side of the wall 22 so that two stacks of receptacle may be placed next to one another in nested relation, as shown in FIG. 7. In one alternative embodiment, it is contemplated that widths w1 and w2 are about the same. In one form of this alternative embodiment, bottom 70 is removed to provide a top opening at top portion 66 and a bottom opening at bottom portion 68. The liners 90 may be inserted and/or removed through either the top or bottom opening. In yet another embodiment, it is contemplated that w2 is greater than w1, and the bags are inserted and removed through a bottom opening at bottom portion 68.

Dispenser 60 is engaged to container 20 by integrally forming a wall portion 74 of body 62 as an extension of the lip 34. In an alternative embodiment, the wall portion 74 is bolted, riveted or welded to the lip 34 in order to secure dispenser 60 to container 20. In yet another embodiment, wall portion 74 is attached directly to the wall 22 of container 20. Other methods for attaching wall body 62 to lip 34 or wall 22 that would normally occur to those skilled in the art are also contemplated herein.

Dispenser 60 has been depicted in FIGS. 1–4 as having an orientation with widths w1 and w2 substantially perpendicular to a vertical axis L extending through container portion 20. Other embodiments contemplate that dispenser 60 be oriented such that widths w1 and w2 extend substantially parallel to longitudinal axis L. Such a configuration would require the insertion and withdrawal of the liners 90 from cavity 64 in a direction transverse to the axis L.

It is also contemplated herein that dispenser 60 may have a shape and/or size that differs from the dispenser depicted in FIGS. 1–4. For example, dispenser 60 may have width w1 and/or w2 that is greater than its length 1. The body 62 of dispenser 60 may define a square, rectangular, circular, oval, or racetrack-shaped cross-section. There are also varying spatial relationships between the container 20 and dispenser 60 contemplated herein. In FIG. 4, the dispenser 60 is separated from the outside surface 24 of wall 22 by a distance d1 at top portion 66 and by a greater distance d2 at bottom portion 68. Alternative embodiments contemplate that distance d2 may be equal to or less than distance d1, such as the dispenser 60' of FIG. 4 shown in phantom lines.

Now that dispenser 60 has been described, the mechanism for engaging a liner 90 to container 20 will be described. Container 20 is provided with a first bag retaining element 38 and a second bag retaining element 39. Preferably, first and second bag retaining elements 38, 39 extend from outer surface 24 of wall 20 below top edge 30. First bag retaining element 38 is positioned on a first side 23 of wall 22 and second bag retaining element 39 is positioned on a second side 25 of wall 22. Preferably, first side 23 and second side 25 are opposite each other about axis L of container 20.

First liner retaining element 38 includes a first flange 40*a* spaced a distance s from a second flange 40*b*. Second liner retaining element 39 is identical to first liner retaining element 38 and includes a third flange 40*c* spaced an identical distance s from a fourth flange (not shown). A first handle 48 is positioned on wall 22 between first flange 40*a* and second flange 40*b*, and a second handle (not shown) identical to handle 48 is positioned on wall 22 between third flange 40*c* and the fourth flange (not shown). The first and second handles are configured to allow waste receptacle 10 to be easily lifted by a person. In one embodiment, the first and second handles are not provided with the receptacle 10. In another embodiment, the first and second handles are positioned on wall 22 below retaining elements 38, 39.

The flanges 40*a*, 40*b*, 40*c*, and the fourth flange (not shown) (collectively the flanges 40) each have a body 44 defining a concave surface 46. Each flange 40 is attached to outer surface 24 of wall 22 along an edge 45 of the body 44. In the illustrated embodiment, edge 45 is integrally formed with wall 22 on outer surface 24. Other embodiments contemplate other means for engaging flanges 40 to wall 22, including mounting the flanges 40 to a base plate and affixing the base plate to the wall. The flanges 40 are oriented so that concave surface 46 faces downwardly towards bottom surface 36 of container 20. Each of the flanges 40 includes a projection 47 adjacent concave surface 46 remote from the wall 22. Projection 47 prevents strap 94 of liner 90 from slipping or migrating away from wall 22 along concave surface 46, causing the liner 90 to collapse within storage space 28 of container 20.

Other embodiments of the present invention contemplate other configurations for flanges 40. For example, in one embodiment flange 40 has a body shaped like a cylindrical hook, with one end of the hook being integrally formed with wall 22 and extending outward therefrom to another end having a hook portion for receiving strap 94 of liner 90. In another embodiment, the flange 40 is a knob having a cylindrical or square, or rectangular cross-section and integrally formed at one end with wall 22. The other end of the knob would have an enlarged tip for engaging and retaining strap 94 of liner 90. Other configurations and shapes for flange 40 are also contemplated herein as would occur to one skilled in the art to which the invention relates.

With liner 90 placed within storage space 28 of container 20, the straps 94 are placed around corresponding ones of liner retaining elements 38, 39 in order to maintain the positioning of liner 90. As waste or other debris is placed within the belly portion 92 of liner 90, the flanges 40 resist displacement of the bag or liner 90 towards bottom surface 36 of container 20. The first and second retaining elements 38, 39 also maintain the liner 90 in an open position so that waste or debris may easily be placed therein.

The present invention is advantageous over the prior art in that it allows storage of a plurality of the liners 90 adjacent to or proximate the container 20. A plurality of bags or liners 90 may be placed within dispenser 60, thus minimizing the number of times the dispenser 60 must be refilled with liners 90. When it is necessary to remove a liner 90 from storage space 28, a second liner 90 is withdrawn from cavity 64 of dispenser 60 and placed within storage space 28. The straps 94*a*, 94*b* are then engaged to a corresponding one of first and second retaining elements 38, 39 in order to secure the position of the liner 90 within container 20. Thus, retaining elements 38, 39 and dispenser 60 make use of liners 90 convenient and inexpensive, and allows the disposal of waste in an efficient manner. The retaining elements 38, 39 and dispenser 60 also encourage recycling and reuse of liners 90 that have an initial use for a purpose other than that of storing and collecting waste, such transporting groceries or other goods from a store. Once the liner is brought home, it may be "stuffed" into the dispenser 60 and stored for later use as a liner within storage space 28.

Figure 4A:
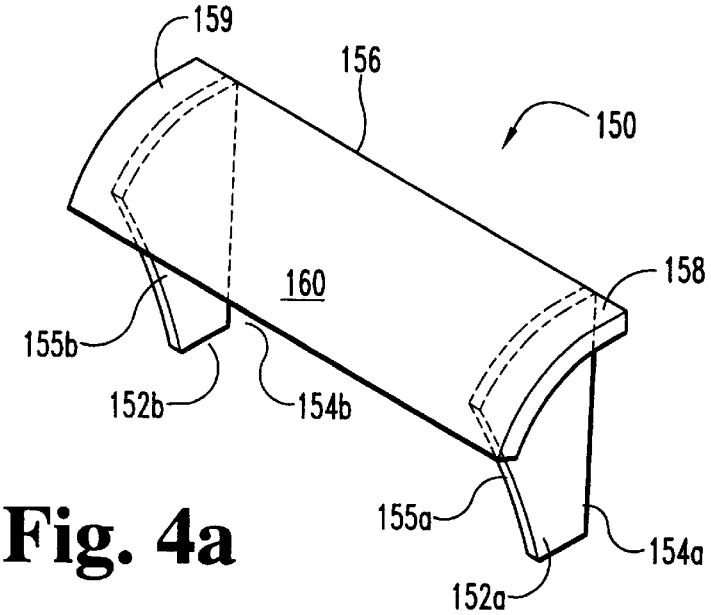
FIG. 4*a* is a perspective view of an alternative embodiment liner retaining element usable with the waste receptacle of FIG. 1.

Referring to FIG. 4*a*, an alternative embodiment of a liner retaining element according to the present invention is illustrated and designated at 150. A retaining element 150 may be secured to wall 22 on first side 23 and on second side 25 as described above with respect to first and second retaining elements 38, 39. Retaining element 150 includes a first flange 152*a* and a second flange 152*b*. Flanges 152*a* and 152*b* are secured to wall 22 along edge 154*a* and 154*b*, respectively. A hood 156 is provided over the top of flanges 152*a* and 152*b*. Hood 156 has a first portion 158 extending beyond flange 152*a* and a second portion 159 extending beyond flange 152*b*. Each flange 152*a*, 152*b* has a concave surface 155*a*, 155*b* for receiving strap 94. Hood 156 extends outward from wall 22 and has a curved portion 160 curving downward outward of concave surfaces 155*a*, 155*b*. Strap 94 is removably engaged by hood 156 when placed against concave surfaces 155*a*, 155*b* at first portion 158, second portion 159, and curved portion 160. Hood 156 can also serve as a handle for the receptacle 10.

Figure 5:
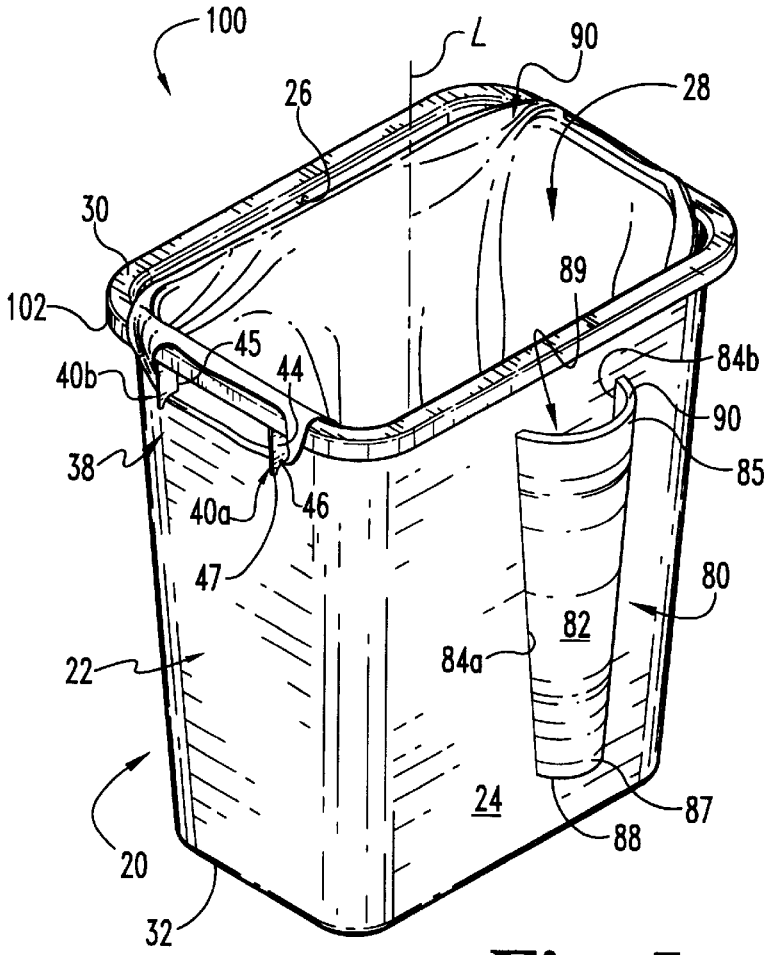
FIG. 5 is a perspective view of an alternative embodiment waste receptacle according to the present invention.

Referring now to FIG. 5, an alternate embodiment of the waste receptacle 10 is designated generally at 100. Like numerals are used to designate like elements with the waste receptacle 10. Receptacle 100 includes a continuous and uniform lip 102 adjacent top edge 30. A dispenser 80 extends from outer surface 24 of wall 22. Dispenser 80 includes a wall 82 extending between a top portion 85 and a bottom portion 87. Dispenser 80 has a top opening 90 at top portion 85 and a bottom opening 88 at bottom portion 87.

Dispenser 80 is engaged to outer surface 24 of wall 22 along edges 84*a* and 84*b*. Edges 84*a* and 84*b* preferably extend between top portion 85 and bottom portion 87. A cavity 89 is thus defined by wall 22 of container 20 and wall 82 of dispenser 80. Cavity 89 extends between top opening 90 and bottom opening 88. Dispenser 80 thus allows insertion of a plurality of bags 90 within cavity 89 without creating a build-up of pressure within the cavity 89 of dispenser 80 as the bags are inserted. Preferably, the dispenser 80 is integrally formed and molded with the wall 22 along edges 84*a* and 84*b*. However, other methods of attaching dispenser 80 to wall 22 are contemplated herein, including, but not limited to, welding, riveting, or bolting, the dispenser 80 to the container 20.

Figure 6:
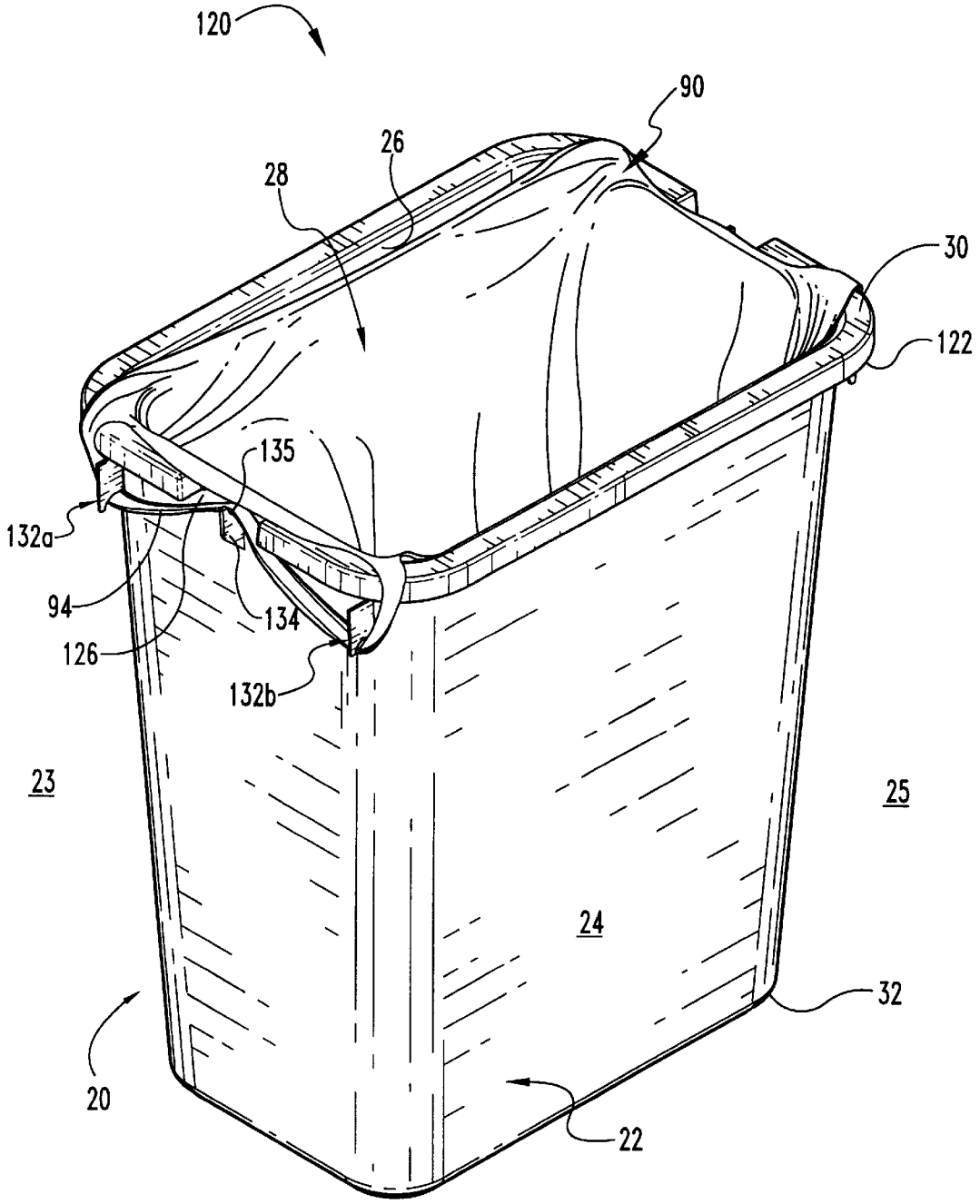
FIG. 6 is a perspective view of another alternative embodiment waste receptacle according to the present invention.

Referring now to FIG. 6, another embodiment of a waste receptacle 10 described above is illustrated and designated generally at 120. Again, like numerals are used to designate like elements with respect to waste receptacle 10. Waste receptacle 120 includes a container 20 having a lip 122 extending adjacent top edge 30. It should be noted that the receptacle 120 does not include any type of dispenser or compartment engaged to lip 122 or wall 22 for storing a plurality of liners 90.

Receptacle 120 of FIG. 6 also illustrates another embodiment of a liner retaining element according to the present invention, designated generally at 130. Receptacle 120 includes a first liner retaining element 130 on first side 23 and a second liner retaining element (not shown) on second side 25. The first and second liner retaining elements are identical, and will be described with reference to first liner retaining element 130. Liner retaining element 130 includes first and second flanges 132*a* and 132*b*, which are similar to flanges 40 described above and configured to receive and retain a strap 94 of liner 90. A tab 134 is positioned between flanges 132*a* and 132*b* and projects from outer surface 24 of wall 22 along side 23. Tab 134 is positioned adjacent to top edge 30 at a discontinuity 126 formed in lip 122. Tab 134 defines a catch surface 135 disposed away from bottom edge 32. Thus, catch surface 135 is positioned above the concave surfaces of flanges 132*a* and 132*b*. Tab 135 is preferable integrally formed with outer surface 24 of wall 22. An identical discontinuity in lip 122 and a second tab are provided on opposite side 25 of container 120 along with third and fourth flanges identical to flanges 132*a*, 132*b*.

The relationship between tab 134 and positioning of flanges 132*a* and 132*b* allow liner 90 to be securely positioned within storage space 28. When the liner is placed in storage space 28, strap 94 is engaged by flanges 132*a* and 132*b*, in a manner similar to that described with respect to flanges 40. If strap 94 were loosely engaged to flanges 132*a* and 132*b* due to, for example, being stretched during a prior use of the liner 90, then the strap may be placed within catch surface 135 of tab 134 in order to further tighten the engagement of the strap to container 20. The tab 134 enables a liner 90 fitting loosely around flanges 132*a* and 132*b* to be tightened, thus securing liner 90 to container 20.

Each of the above embodiments of the waste receptacle 10, 100, 120 may be made preferably from a plastic type material in a unitary injection molding type process. However, the waste receptacle 10, 100, 120 may be made from metal or other suitable material and may be fabricated by bolting, riveting, or heat welding the components. It is believed the techniques and methods for the materials and manufacture of waste receptacles 10, 100, 120 are within the capabilities of those skilled in the art to which the invention relates.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A receptacle for storing waste, comprising:

a container having a wall with an inner surface and an opposite outer surface, said wall extending between a top edge of said container and an opposite bottom edge of said container, said inner surface defining a storage space for storing waste;

a liner disposed within said storage space of said receptacle, said liner having a portion extending outside said storage space; and at least one liner retaining element on said wall configured to receive said portion of said liner, said liner retaining element preventing collapse of said liner in said storage space, said at least one liner retaining element including a first flange spaced a distance from a second flange and a tab having a catch surface disposed towards said top edge positioned between each of said flanges, said flanges and said tab engaged to and extending from said outer surface of said wall.

2. The receptacle of claim 1, wherein said liner includes a belly portion for lining said storage space and said outside portion of said liner comprises a pair of straps extending from said belly portion.

3. The receptacle of claim 2, wherein said portion of said liner received by said at least one liner retaining element is a corresponding one of said straps.

4. The receptacle of claim 1, wherein said at least one liner retaining element is positioned on said outer surface on a first side of said container.

5. The receptacle of claim 4, further including a second liner retaining element positioned on said outer surface on a second side of said container, said second liner retaining element including a third flange spaced a distance from a fourth flange and a second tab positioned between said third and fourth flanges.

6. The receptacle of claim 5, wherein said first side of said container is opposite said second side.

7. The receptacle of claim 1, further comprising a lip extending around said top edge, said lip having a discontinuity formed therein at said tab.

8. The receptacle of claim 1, wherein each of said flanges includes a body defining a concave surface disposed away from said top edge and said catch surface is positioned closer to said top edge than said concave surfaces.

9. A receptacle for storing waste and for storing a plurality of liners for lining the receptacle, the receptacle comprising:

a container having a wall with an inner surface and an opposite outer surface, said wall extending between a top edge of said container and an opposite bottom edge of said container, said inner surface defining a storage space for storing waste;

a first liner retaining element and a second liner retaining element disposed on said outer surface of said wall, each of said liner retaining elements configured to receive a portion of one of the liners disposed in said storage space to prevent collapse of the one liner into said storage space, wherein said first and second liner retaining elements each include a pair of spaced flanges projecting from said wall and a tab extending from said wall between said spaced flanges, said tab including a catch surface disposed towards said top edge; and a dispenser engaged to said container, said dispenser defining a storage cavity wherein individual ones of the plurality of liners may be selectively placed in said storage cavity and retrieved therefrom for disposition in said storage space of said container.

10. The receptacle of claim 9, further comprising a lip extending around said top edge, said lip having a discontinuity formed therein at said tab.

11. The receptacle of claim 9, wherein each of said flanges includes a body defining a concave surface disposed away from said top edge and said catch surface is positioned closer to said top edge than said concave surfaces.

12. The receptacle of claim 9, wherein said dispenser has a body defining said storage cavity, said body having a length extending between a top portion and a bottom portion, said top portion of said dispenser engaged to said top edge of said container.

13. The receptacle of claim 12, wherein said dispenser defines an opening at said top portion, said opening defining a plane substantially parallel with a plane defined by said top edge of said container.

14. The receptacle of claim 13, wherein said dispenser has a profile that tapers from a first dimension at said top portion to a second dimension at said bottom portion.

15. The receptacle of claim 14, wherein said first dimension is greater than said second dimension.

16. The receptacle of claim 12, wherein said body defines a slot extending from said opening toward said bottom surface along at least a portion of said length of said body.

17. The receptacle of claim 12, wherein said body is spaced a distance from said outer surface of said wall of said container along substantially said entire length of said body.

18. The receptacle of claim 17, wherein said distance increases from said top portion to said bottom portion.

19. The receptacle of claim 9, wherein said dispenser has a body, said body has a length extending between a top rim and a bottom surface, said body engaged to said outer surface of said wall of said container, said body and said outer surface defining said storage cavity for a plurality of liners.

* * * * *